United States Patent [19]

Heckert

[11] 4,049,585

[45] Sept. 20, 1977

[54] DETERGENT COMPOSITIONS CONTAINING INTERNAL VICINAL DISULFATES

[75] Inventor: David Clinton Heckert, Oxford, Ohio

[73] Assignee: The Procter & Gamble Company, Cincinnati, Ohio

[21] Appl. No.: 639,933

[22] Filed: Dec. 11, 1975

Related U.S. Application Data

[63] Continuation-in-part of Ser. No. 537,513, Dec. 30, 1974, abandoned, and Ser. No. 537,512, Dec. 30, 1974, abandoned.

[51] Int. Cl.[2] ..... C11D 1/16; C11D 3/06

[52] U.S. Cl. ..... 252/531; 252/526; 252/527; 252/545; 252/546; 252/550; 260/458 R; 260/526 S

[58] Field of Search ..... 252/99, 95, 531, 526, 252/545, 550, 557; 260/458 R, 459 R

[56] References Cited

U.S. PATENT DOCUMENTS

| | | | |
|---|---|---|---|
| 2,007,492 | 7/1935 | Bertsch | 260/458 R |
| 2,091,956 | 9/1937 | Benner | 260/458 R |
| 3,686,098 | 8/1972 | Weil | 252/550 |
| 3,714,076 | 1/1973 | Anderson | 252/550 |
| 3,755,180 | 8/1973 | Austin | 252/99 |
| 3,850,854 | 11/1974 | Weil | 252/551 |
| 3,936,317 | 2/1976 | Lehmann et al. | 134/29 |

FOREIGN PATENT DOCUMENTS

| | | |
|---|---|---|
| 1,910,765 | 10/1969 | Germany |

*Primary Examiner*—P.E. Willis, Jr.

*Attorney, Agent, or Firm*—Robert B. Aylor; Thomas H. O'Flaherty; Richard C. Witte

[57] ABSTRACT

Detergent compositions are disclosed incorporating vicinal non-terminal disulfates as low sudsing surfactants and for their enhanced hard surface detergency characteristics.

6 Claims, No Drawings

DETERGENT COMPOSITIONS CONTAINING INTERNAL VICINAL DISULFATES

REFERENCE TO RELATED APPLICATIONS

This application is a continuation-in-part of my copending applications USSN No. 537,513 for DETERGENT COMPOSITIONS filed Dec. 30, 1974 now abandoned and USSN No. 537,512 for INTERNAL VICINAL DISULFATES filed Dec. 30, 1974 now abandoned.

BACKGROUND OF THE INVENTION

This invention relates to detergent compositions incorporating internal vicinal disulfates as the, or one of the surfactants.

In the constant search to improve organic detergent products, surfactants have been sought which have a combination of features such as detergency, sudsing, solubility, soil suspension, etc. that are independent of each other and hence would provide the greatest flexibility in formulation. Although there are a number of surfactants which approach this ideal, a satisfactory balance of properties is often difficult to achieve as they are mutually exclusive. In particular, a balance between sudsing and detergency has been found to be difficult to realize in a single surfactant.

Low sudsing is a highly desirable property for a surfactant intended for use in automatic dishwashing detergents. This characteristic is a feature of a large number of nonionic surfactants but is not possessed by many anionic materials. Additionally, anionic surfactants having satisfactory detergency characteristics generally display relatively high sudsing properites under the same conditions.

Alkyl disulfates as a broad class of compounds are known in the detergent art. For example, U.S. Pat. No. 3,714,076, Jan. 30, 1973, and U.S. Pat. No. 3,634,269, Jan. 11, 1972, both to R. G. Anderson, disclose 1,3-, 1,2-, and 1,4-disulfate surfactants. In addition, internal disulfates of non-vicinal variety are disclosed in U.S. Pat. No. 3,686,098, Aug. 22, 1972, to Ira Weils, where their general utility is stated to be as a laundry aid in phosphate-free detergents. Vicinal alkane diols themselves are disclosed in U.S. Pat. No. 3,775,300, issued Nov. 27, 1973, to Heimold Batha as components of detergent compositions useful for automatic dishwashing.

There appears, however, to have been no appreciation prior to the present invention that certain internal vicinal disulfates are low-foaming, hardness insensitive surfactant detergents which are particularly useful combined with polyethoxylated nonionic surfactant detergents. That they are low-foaming surfactants was quite unexpected since anionic surfactants such as higher molecular weight alkyl sulfates, alkyl sulfonates, or arylalkyl sulfonates are not known to exhibit low-foaming surface activity; and prior disulfates, likewise, are not known to exhibit low-foaming and surface activity.

SUMMARY OF THE INVENTION

This invention relates to detergent compositions incorporating internal vicinal disulfate, surface-active compounds which are useful as detergents. The vicinal disulfate, surface-active compounds are characterized by the structure

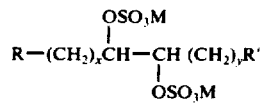

wherein $x$ and $y$ are integers from 1 to 21 inclusive; the sum of $x + y = 5$ to 22; and R and R′ are each independently selected from the group consisting of hydrogen, —COOM,

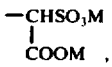

$-COOCH_3$, $-CONR''_2$ and $-CONR''SO_3M$ wherein R″ is hydrogen, methyl, or ethyl; and M is a cation selected from the group consisting of alkali metal, alkali earth metal, ammonium and alkanolammonium, preferably $C_1$–$C_5$ alkanolammonium, cations;

and a material selected from the group consisting of inorganic and organic detergent builders, anionic, nonionic, and zwitterionic surfactants, and mixtures thereof, the ratio of said compound to said material being in the range of about 4:1 to about 1:40 by weight Applicant has made the surprising discovery that internal vicinal disulfates, i.e., compounds having the ($OSO_3M$) groups located internally in the molecule on adjacent carbon atoms are low-foaming, surface-active compounds that display enhanced hard surface detergency properties. It has been surprisingly discovered that the arrangement of the two sulfate groups on adjacent internal carbon atoms contributes unexpectedly to the detergent properties of this molecule and makes it especially useful for certain applications such as automatic dishwashing detergent compositions where good detergency and low sudsing are required. It has also been surprisingly discovered that certain "hard-to-remove"soils commonly encountered, e.g., in dishwashing, are removed much better by these internal vicinal disulfates, which makes their combination with other surfactants, especially ethoxylated nonionic detergents, desirable.

Internal Vicinal Disulfate Synthesis

In general, the internal vicinal disulfates of the present invention are prepared by synthetic methods involving:

1. the preparation of an internal vicinal diol from mono-internal olefins of linear or branched chains having from 10 to 24 carbon atoms; and
2. the sulfation of the internal vicinal diol to the corresponding disulfuric acid and its subsequent neutralization to give the disulfate.

The starting materials for the present invention are linear or branched mono-olefins of 10 to 24 carbon atoms whose unsaturation is internal, and preferred mon-olefins are those whose double bond position is randomized within the molecule.

The olefins are treated, e.g., by epoxidation with the aid of organic peroxyacids, or by hydroxylation with hydrogen peroxide, to give the internal vicinal diols which are then sulfated with at least two moles of sulfating agent per mole of diol.

The preparation of internal vicinal disulfates from random internal mono-olefins is set out schematically below.

(1) Internal olefin hydrolysis

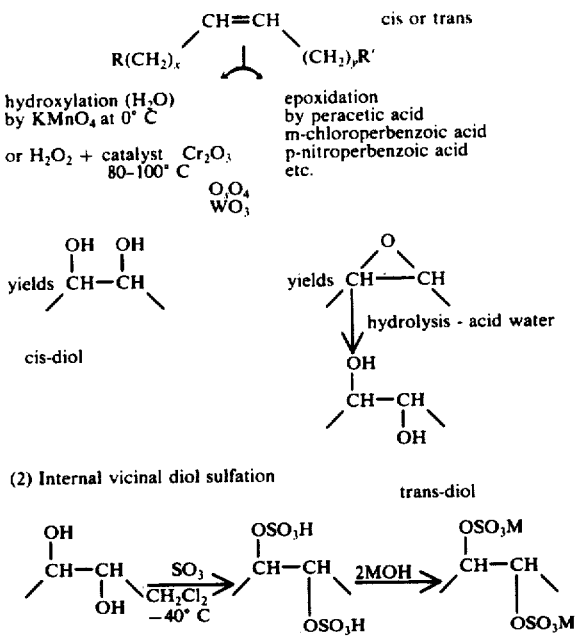

(2) Internal vicinal diol sulfation

The olefins are first converted to internal vicinal diols by epoxidation or hydroxylation reactions.

Hydroxylation is commonly carried out using potassium permanganate in an aqueous alkaline medium at a temperature of approximately 0° C. This procedure is outlined in Fieser & Fieser, *Reagents for Organic Synthesis,* volume 1, page 948, 1967, published by John Wiley and Sons, Inc., and is incorporated herein by reference. Alternatively, the reaction can utilize aqueous hydrogen peroxide and a catalyst such as osmium tetroxide, chromium oxide, or tungsten oxide. This reaction procedure is discussed generally at pages 220–223 of *Reactions of Organic Compounds* by Reynold C. Fuson, published by John Wiley and Sons, Inc., 1967. Both reference are incorporated herein by reference. Another discussion of this procedure is given by Itakura, Tanaka & Ito in *Bulletin of the Chemical Society of Japan,* volume 42, 1969, pages 1604–1608. Hhydroxylation under alkaline conditions gives the cis-diol.

Epoxidation conventionally utilizes a peroxyacid such as peracetic or m-chloroperbenzoic acid to add an oxygen atom across the olefinic double bond which is then hydrolyzed under aqueous acid conditions to give the trans-diol. A discussion of this reaction sequence is given by Swern, Billeu and Scanlan, in *Journal of the American Chemical Society,* volume 68, 1946, pages 1504–1507, incorporated herein by reference.

The diols may be converted by disulfates by sulfation with chlorosulfonic acid, $SO_3$, oleum, and other known sulfating agents. Sulfur trioxide is preferred.

The reaction of the sulfating agent with the internal vicinal diol is carried out in an inert solvent medium such as dichloromethane or trichloromethane. In a first step at least two moles of a sulfating agent, e.g., sulfur trioxide ($SO_3$) is reacted with one mole of diol or diol mixture. The reaction to give the corresponding disulfuric acid derivative goes substantially to completeness.

Conventionally, a slight excess (2–10 mole %) of suflating agent is used to ensure that maximum completeness is obtained. Under the conditions employed (i.e., low temperatures, −60° C to −80° C, vigorous agitation) little or no charring of the product takes place. The use of greater excesses of sulfating agent will, however, give rise to discolored product.

Where the terminal groups R and R′ of the diol are other than hydrogen, e.g., are —CONHR″ or —COOM, the use of excess sulfating agent can result in the formation of the disulfate-sulfonate derivative, sulfonation taking place on the carbon atom alpha to the carboxy group or on the hydrogen of the amido group respectively. This reaction proceeds very slowly at temperatures of −60° C to −80° C but is quite rapid if the sulfation is carried out at ambient temperatures with at least three moles of sulfating agent per mole of diol. Disulfate-sulfonate materials are valuable for the purposes of the present invention and can conveniently be prepared in the foregoing manner. General procedures for this reaction are described in "Sulfonation and Related Reactions" by E. E. Gilbert, Chapter VII, pages 345–365, Interscience Publishers, b 1965, incorporated herein by reference.

After sulfation, the reaction product is then neutralized with an aqueous solution of one or more basic compounds such as the hydroxides, carbonates, and oxides of the alkali metals and alkali earth metals. Ammonia and lower alkanolamines such as mono-, di-, and triethanolamine can also be used. The neutralized disulfate is then worked up by conventional extraction and crystallization techniques.

The following are non-limiting examples of the preparation of internal vicinal disulfates in accordance with the present invention.

EXAMPLE I a. Preparation of $C_{16}$ random, internal vicinal alkandiol 120 grams of random, internal epoxyhexadecane was placed in a glass-lined autoclave with 40 ml. of 10% $H_2SO_4$. The mixture was heated to 150° C for 3 hours under 300 psi $N_2$. Upon cooling, the product solidified in the autoclave. The aqueous portion was decanted, and the solid was dissolved in hot hexane. The solution was dried over anhydrous, $MgSO_4$, filtered, and cooled. The resulting crystals were removed by filtration to yield approximately 95% of pure random, internal vicinal hexadecane diol.

b. Preparation of $C_{16}$ random, internal vicinal alkandiol disulfate

One and one-half moles (309 gm.) of random, internal vicinal hexadecane diol was dissolved in 5 liters of methylene chloride and cooled to −65° C. The solution was rapidly stirred and 3.1 moles of liquid $SO_3$ was added dropwise over a period of 1 hour keeping the temperature below −50° C during the addition. After a total of 4 hours, 250 ml. of 50% NaOH solution was added dropwise. After completion of the addition, the resultant slurry mixture was allowed to warm slowly to room temperature. The residue was removed by filtration and slurried in 2 liters of hexane. The solids were removed by centrifuging and extracted with hot 2-propanol and then 90% ethanol. The 2-propanol fraction contained 58 gm. of a mixture of 85% disulfate and 15% monosulfate, and the ethanol fraction yielded 200 gm. of the disulfate.Recrystallization from 90% ethanol yielded pure random, internal vicinal hexadecane diol disulfate analyzing as C = 41.58%, H = 6.92%, and S = 13.75%. Calculated for the hexadecane diol disulfate: C = 41.56%, H = 6.93%, and S = 13.85%.

EXAMPLE II a. Preparation of 9,10-dihydroxystearic acid

Oleic acid (100 gm.), glacial acetic acid (30 gm.), and concentrated sulfuric acid (1.9 gm.) were placed in a rapidly-stirred vessel; and 115 ml. of 30% $H_2O_2$ was added dropwise over one-half hour. The reaction mixture was then heated to 65° for three hours, and then poured into hot water. The light yellow oil that separated was separated and poured into excess 3N NaOH. This mixture was heated on a steam bath for one hour, and then poured into cold 4N HCl. Upon cooling, the white precipitate was removed by filtration, washed several times with water, and air dried. The total yield of 99% pure 9,10-hydroxystearic acid was 98gm. or 97% yield.

b. Preparation of the disulfate of 9,10-dihydroxystearic acid

A total of 98gm. of 9,10-dihydroxystearic acid was slurried in 1.5 liters of $CH_2Cl_2$ and cooled to approximately −65° C. To the rapidly-stirred slurry was added dropwise 37 ml. of liquid $SO_3$over a period of 30 minutes. After stirring an additional 3 hours at −50° to −65° C, 120 ml. of 50% NaOH solution was added. After warming to room temperature, the residue was filtered and the solids were extracted with one liter of hot 90% ethanol. The residue, 80 gm. of a yellow powder, was predominantly the trisodium salt of 9,10-dihydroxystearic acid disulfate. The product was recrystallized from 90% ethanol to yield a slightly yellowish powder which had an indistinct melting point (~100° C). N.M.R. analysis indicated that sulfation was complete: protons adjacent both hydroxyl groups (broad multiplet at 6.4τ) had shifted to 5.25τ and a strong sulfate band appeared in the infra-red at 1200 cm.$^{-1}$, thus confirming the production of the trisodium salt of dihydroxystearic acid disulfate.

EXAMPLE III a. Preparation of $C_{12}$ random internal vicinal diol

The procedure of Example I*a* was followed using random internal epoxydodecane as a starting material to provide the $C_{12}$ random internal vicinal diol in a yield of >99%.

b. Preparation of $C_{12}$ internal vicinal disulfate

| | | |
|---|---|---|
| Materials: | $C_{12}$ random internal diol | 50 gm (0.25M) |
| | liquid $SO_3$ | 22 ml |
| | dichloromethane | 500 ml |
| | 50% NaOH | 25 ml |

Procedure: The $C_{12}$ random internal vicinal diol was dissolved in $CH_2Cl_2$ and stirred slowly in a dry 1-liter flask, 3-necked round bottom flask equipped with an (explosion proof) paddle stirrer, a drying tube condenser, and dropping funnel and continuously flushed with argon. The flask was immersed in a dry ice/acetone mixture and cooled to about −75° C. Preheated liquid $SO_3$, maintained just below its boiling point (approximately 55° C), was added to the diol solution at about 2-3 drops per second. Stirring was continued for four hours at about −75° C. The reaction mixture was warmed slightly to about −50° C, and 25 ml. of 50% sodium hydroxide was added dropwise. When the addition was completed, the reaction solution was allowed to warm to room temperature. The pH was adjusted to 8-9 with additional dilute sodium hydroxide, and the product was poured into hexane and the water layer separated. The hexane layer was then evaporated to dryness and the residue taken up in boiling isopropanol, filtered while hot, and the filtrate cooled to precipitate sodium $C_{12}$ random internal vicinal disulfate. The filtered solids were recrystallized from 95% ethyl alcohol to give a white crystalline solid having a M. pt. >240° C. Infra-red and N.M.R. spectral analysis confirmed the compound to be the sodium $C_{12}$ random internal vicinal disulfate.

EXAMPLE IV a. Preparation of $C_{20}$ random internal vicinal diol

The procedure of Example I*a* was followed using random internal epoxyeicosane as a starting material to provide the $C_{20}$ random internal vicinal diol in a yield of >99%.

b. Preparation of $C_{20}$ internal vicinal disulfate

| | | |
|---|---|---|
| Materials: | $C_{20}$ random internal diol | 50 gm (0.15M) |
| | liquid $SO_3$ | 12 ml |
| | dichloromethane | 500 ml |
| | 50% NaOH | 15 ml |

Procedure: The $C_{20}$ random internal vicinal diol was dissolved in $CH_2Cl_2$ and stirred slowly in a dry 1-liter flask, 3-necked round bottom flask equipped with an (explosion proof) paddle sitrrer, a drying tube condenser, and dropping funnel and continuously flushed with argon. The flask was immersed in a dry ice/acetone mixture and cooled to about −75° C. Preheated liquid $SO_3$, maintained just below its boiling point (approximately 55° C), was added to the diol solution at about 2-3 drops per second. Stirring was continued for four hours at about −75° C. The reaction mixture was warmed slightly to about −50° C, and 15 ml. of 50% sodium hydroxide was added dropwise. When the addition was completed, the reaction solution was allowed to warm to room temperature. The pH was adjusted to 8-9 with additional dilute sodium hydroxide, and the product was poured into hexane and the water layer separated. The hexane layer was then evaporated to dryness and the residue taken up in boiling isopropanol, filtered while hot, and the filtrate cooled to precipitate sodium $C_{20}$ random internal vicinal disulfate. The filtered solids were recrystallized from 95% ethyl alcohol to give a white crystalline solid having a M. pt. of 158°-161° C. Infra-red and N.M.R. spectral analysis showed this compound to be the sodium $C_{20}$ internal vicinal disulfate.

The compounds of this invention have utility as surfactants for use in detergents for manual and mechanical dishwashing. These internal vicinal disulfates, in addition to the above properties, are useful in removing baked-on soils and do not interfere with the sudsing performance of other surfactants. While the reason for this is not fully understood, it is believed that it is attributable, in part, to the very high critical micelle concentration (CMC) of the compounds of the present invention and the reduced tendency of the compounds to concentrate at the air-solution interface.

This class of compounds is illustrated by the following specific examples: 2,3-n-decane disulfate; 3,4-n-decane disulfate; 4,5-n-decane disulfate; 2,3-n-undecane disulfate; 3,4-n-undecane disulfate; 4,5-n-undecane disulfate; 5,6-n-undecane disulfate; 2,3-n-dodecane disulfate; 3,4-n-dodecane disulfate; 4,5-n-dodecane disulfate; 5,6-n-dodecane disulfate; 6,7-n-dodecane disulfate; 2,3-n-tridecane disulfate; 3,4-n-tridecane disulfate; 4,5-n-tridecane disulfate; 5,6-n-tridecane disulfate; 6,7-n-tridecane disulfate; 2,3-n-eicosane disulfate; 3,4-n-eicosane disulfate; 4,5-n-eicosane disulfate; 5,6-n-eicosane disulfate; 6,7-n-eicosane disulfate; 7,8-n-eicosane disulfate; 8,9-n-eicosane disulfate; 9,10-n-eicosane disulfate; 10,11-n-eicosane disulfate; 10,11-n-doeicosane disulfate; and 11,12-n-doeicosane disulfate.

Examples of compounds in which the terminal carbon atoms are not fully substituted by hydrogen include: 9,10-dodecanoic acid disulfate; 5,6-tetradecanoic acid disulfate; 9,10-tetradecanoic acid disulfate; 9,10-hexadecanoic acid disulfate; 6,7-octadecanoic acid disulfate; 9,10-octadecanoic acid disulfate; 11,12-octadecanoic acid disulfate; 9,10-eicosanoic acid disulfate; 11,12-eicosanoic acid disulfate; and 13,14-docosanoic acid disulfate.

Specific reference to the above compounds is given only for the purpose of illustration, and it will be appreciated that many other similar variations may be used in this invention so long as the general formula requirements are observed.

The preferred compounds of this invention are those of the general formula given above wherein $x$ and $y$ are integers from 2 to 16, R and R' are both hydrogen, and the sum of $x + y = 10$ to 18. Illustrative of this preferred group is 2,3-n-dodecane disulfate; 4,5-n-dodecane disulfate; 2,3-n-hexadecane disulfate; 6,7-n-hexadecane disulfate; 2,3-n-eicosanedisulfate; and 9,10-n-eicosane disulfate.

The discovery that positioning the sulfate groups internally in the molecule on adjacent carbon atoms as described herein produces a compound having cleaning performance superior to that of its terminal or internal non-vicinal counterparts was totally unexpected. Such products used in aqueous solution are excellent cleaners, especially for solid and particulate soils, and are in addition, low foamers so that combination with foam-supressing additives is not necessary.

Compounds of this invention are useful per se as detergents and surface active agents. Desirably they are used with other materials to form detergent compositions, for example, bar, flake, granular tableted, granular, or liquid compositions. Such detergent compositions can contain from about 2% to about 80% of the internal vicinal disulfates of this invention and from about 98% to about 20% of anionic detergents, nonionic organic detergents, water-soluble inorganic alkaline builder salts, water-soluble organic alkaline sequestrant builder salts or mixtures thereof.

Granular or flake detergents preferably contain about 3% to about 50% of the internal vicinal disulfates of this invention and from about 97% to about 50% normally solid, water-soluble inorganic alkaline builder salts, or water-soluble organic alkaline sequestrant builder salts. Bar formulations contain about 5% to about 50% of the internal vicinal disulfates of this invention when used with anionic detergents, such as a soap base, and, if desired, alkaline inorganic or organic builders or inert fillers. Bar formulations can contain about 40% to about 80% of the internal vicinal disulfates of this invention as the only detergent component, if desired, and the balance inert fillers or builders.

Preferred built detergent compositions contain about 3% to about 10% by weight of the internal vicinal disulfates of this invention and at least twice as much of a detergency builder.

In preparing detergent compositions, especially valuable as automatic dishwashing compositions, it is desirable to use the internal vicinal disulfate compounds of this invention in admixtures with detergency builder compounds. Excellent compositions consist of an internal vicinal disulfate detergent compound of this invention and at least one detergency builder selected from the inorganic or organic alkaline builders in a proportion by weight disulfate to builder of 10:1 to 1:20 and preferably from 5:1 to 1:10. These compositions provide best overall hard surface cleaning results, including soil removal when used in washing solutions having a pH of 6.5 to 11.5, preferably 7 to 11, and most preferably 8.5 to 11.

Preferred automatic dishwashing compositions are those containing a low amount of conventional sequestering builders, especially phosphates, more preferably, no such builders. Also preferred are those automatic dishwashing compositions containing no bleaching agents. The soil removal characteristics of the internal vicinal disulfates of this invention and especially the alkyl internal vicinal disulfates are such that they compensate for the loss of sequestering builders and/or bleaching agents. In such automatic dishwashing compositions, the internal vicinal disulfates are preferably used in combination with conventional ethoxylated nonionic detergent surfactants which complement the performance of the internal vicinal disulfates. Preferred nonionics are disclosed hereinafter.

Surfactant systems for use in automatic dishwashing products are disclosed in U.S. Pat. No. 3,817,869 to Ries et al issued June 18, 1974, at Column 4, lines 1–60 incorporated herein by reference. Preferred surfactants for such products are the condensation product of one mole of $C_{10}$–$C_{20}$ fatty alcohol, preferably tallow alcohol with from about 4 to about 30, preferably from about 6 to about 15 moles of ethylene oxide, and alkoxylates having the formula $Y[(C_3H_6O)_n(C_2H_4O)_mH]_x$, wherein x has a value of at least 2, n has a value such that the molecular weight of the polyoxypropylene hydrophobic base is at least about 900 and m has a value such that the oxyethylene content of the molecule is from about 10% to 90% by weight and wherein Y is selected from the group consisting of propylene glycol, glycerine, pentaerythritol, trimethylolpropane, ethylene diamine and mixtures thereof.

Light duty liquid detergent formulations preferably contain 3% to 25% of the internal vicinal disulfates, preferably 5% to 15%, most preferably less than 10%, by weight in addition to other nonionic and anionic surfactants, hydrotropes, suds boosters, solubilizers, color, perfume, etc. Small amounts, e.g., less than half of the surfactant content, are preferred to obtain the cleaning benefit without loss of sudsing.

Surfactants which can advantageously be included in the detergent compositions of this invention include anionic, nonionic, and zwitterionic types such as are disclosed in U.S. Pat. No. 3,579,454, issued to Everett J. Collier on May 18, 1971, at Column II, line 49 to Column 14, line 5, this disclosure being specifically incorporated herein by reference.

Preferred surfactants for use in liquid detergents are disclosed in U.S. Pat. No. 3,179,599 to Stanley L. Eaton et al issued Apr. 20, 1965, at Column 1, line 45 to Column 2, line 58 and in U.S. Pat. No. 3,793,233 to Rose and Thiele issued Feb. 19, 1974 both disclosures being incorporated herein by reference.

Water-soluble inorganic alkaline builder salts used alone or in admixture are alkali metal carbonates, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, sodium bicarbonate, potassium tripolyphosphate, potassium pyrophosphate, sodium hexametaphosphate, sodium sesquicarbonate, sodium mono- and di-ortho phosphate and potassium bicarbonate. Such inorganic builder salts enhance the detergency of the subject internal vicinal disulfates.

Examples of water-soluble organic alkaline sequestrant builder salts used alone or in admixture are alkali metal, ammonium or substituted ammonium aminopolycarboxylates, e.g., sodium and potassium ethylenediaminetetraacetate, sodium and potassium N-(2-hydroxyethyl)-ethylenediaminetriacetates, sodium and potassium nitrilotriacetates and sodium, potassium, and triethanolammonium N-(2-hydroxyethyl)nitrilodiacetates. Mixed salts of those polycarboxylates are also suitable. Other organic alkaline sequestrant builder salts which can be used are: Hydroxyethylethylenediaminetriacetates; 2-hydroxyethyliminodiacetates; diethylenetriaminepentaacetates; 1,2-diaminocyclohexanetetraacetates. The alkali metal salts of phytic acid, e.g., sodium phytate are also suitable as alkaline organic sequestrant builder salts (see U.S. Pat. No. 2,739,942). Sodium ethane-1-hydroxy, 1-diphosphonate, and sodium citrate can also be used as builders either alone or in mixtures with other builder compounds. Other suitable builders include methylene and ethylene diphosphonates and their derivatives, ethane-1-hydroxy-1,1,2-triphosphonate, sodium itaconate, and sodium polymaleate and the like.

A further preferred class of detergent builders is the insoluble synthetic aluminosilicate type which functions by cation exchange to remove polyvalent mineral hardness and heavy metal ions from solution. A preferred builder of this type has the formulation $Na_z(AlO_2)_z(SiO_2)_y \cdot x\ H_2O$ wherein z and y are integers of at least 6, the molar ratio of z to y is in the range from 1.0 to about 0.5, and $x$ is an integer from about 15 to about 264. Compositions incorporating builder salts of this type are the subject of the commonly assigned U.S. Application of John Michael Corkill, Bryan L. Madison, and Michael E. Burns, Ser. No. 450,266 filed Mar. 11, 1974 and entitled "Detergent":, and also the subject of both Netherlands Patent Application No. 74/06306 published on Nov. 13, 1974, both disclosures being incorporated herein by reference.

Another type of detergency builder material useful in these compositions and processes comprises a water-soluble material capable of forming a water-insoluble reaction product with water hardness cations in combination with a crystallization seed which is capable of providing growth sites for said reaction product. "Seeded builder" compositions of this type are described in Belgian Pat. No. 798,856 published Oct. 29, 1973, the disclosures of which are incorporated herein by reference.

More particularly, the seeded builders useful herein comprise a crystallization seed having a maximum particle dimension of less than 20 microns, preferably a particle diameter of from about 0.01 micron to about 1 micron, in combination with a material capable of forming a water-soluble reaction product with free metal ions.

As stated hereinbefore, the non-phosphate builders are preferred and low levels of phosphate builders, e.g., less than 35%, preferably less than 15%, are also preferred. The vicinal disulfates, being les subject to the effects of alkaline earth ions, are capable of providing good results even with less efficient builders, such as alkali metal carbonates, silicates, citrates, and zeolites.

Optional ingredients that may be incorporated in the detergent compositions of the invention are enzymes for removal of protein-based or carbohydrate-based stains. Enzymes for removing protein-based stains are proteolytic in nature such as those sold under the trade names "Alcalase" and "Esterase" by Novo Industries A/S Denmark or under the trade names "Maxatase" and "AZ Protease" by Gist-Brocades N.V. The Netherlands. These materials are normally incorporated at levels of up to 2% by weight, preferably 0.25% to 0.75% by weight, and are preferably coated or prilled with inert additives to minimize dust formation and improve storage stability. A wide range of enzyme materials and means for their incorporation into synthetic detergent granules is disclosed in U.S. Pat. No. 3,553,139 issued on Jan. 5, 1971, to McCarty, Roald, Blomeyer, and Cracco which disclosure is hereby incorporated by reference.

A further ingredient that may be incorporated to improve product performance is a bleaching agent of the halogen or oxygen-containing type. Examples of the hypohalite bleach type include chlorinated triorthophosphate, trichloroisocyanuric acid, and the sodium and potassium dichloroisocyanurates and N-chloro and N-bromo alkane sulfonamides. Such materials are normally added at 0.5% to 10% by weight of the finished product, preferably 1% to 5% by weight.

Examples of oxygen-containing bleaches include sodium perborate, sodium percarbonate, and potassium monopersulphate that are incorporated at levels of 5–30%, preferably 10–25% by weight of the final product. The inclusion of organic bleach activators such as phthalic anhydride, tetraacetylethylenediamine, tetraacetylmethylenediamine or tetraacetylglycouril lead to the in situ production during the washing process of the corresponding organic peroxy acids which have enhanced low temperature bleaching performance. Activators of this type are normally used with sodium perborate, at usage levels of 5–15% by weight of the final product.

Materials to boost or modify the sudsing pattern of the compositions of the present invention may also be included. Examples of suds boosters include coconut and tallow mono- and di-alkanolamides, particularly ethanolamides and $C_{12-15}$ alkyl di-lower alkyl amine oxides. Typical suds depressors include long chain fatty acids such as those disclosed in U.S. Pat. No. 2,954,347 issued Sept. 27, 1960 to Wayne St. John and combinations of certain nonionics therewith as disclosed in U.S. Pat. No. 2,954,348 issued Sept. 27, 1960 to Eugene Schwoeppe, both disclosures being incorporated herein by reference.

Other optional ingredients in granular products include hydrotropes and anticaking additives such as salts of lower alkylaryl sulfonic acids, salts of α-sulfosuccinic acid, and α-sulfobenzoic acid, and urea, normally utilized at levels of 0.5% to 5% by weight of the final product, preferably at levels of 1%–3% by weight.

$C_{12}$–$C_{18}$ alkyl acid phosphates and their condensation products with ethylene oxide may also be incorporated at similar levels for control of crutcher mix viscosity. Antiredeposition agents such as carboxymethyl cellulose, hydroxyethyl cellulose, and their derivatives may also be incorporated.

Advantageously, ingredients may also be included to minimize the wrinkling of fabrics that occurs during conventional drying processes. Detergent products incorporating starch and other particulate materials useful as fabric conditioning agents are disclosed in Belgian Pat. No. 811,082 published Aug. 16, 1974, and incorporated herein by reference. A non-limiting example of such a fabric conditioning agent is corn starch, which can be added at a level of 0.1–5.0% by weight of the composition, preferably 0.25–1.0%.

Anti-tarnish and anti-corrosion agents, perfume and colour may also be included, the last ingredient being conveniently added either as a general colour or in the form of a speckle applied to a separate granule fraction of the entire formulation or to a granulate of one or more of the ingredients.

The pH of detergent formulations in accordance with the present invention can lie anywhere within the range 5–12 but is preferably chosen to fall within the range 8.0–10.5 as this provides a slight particulate soil removal benefit on synthetic fabrics. However, the use of specific optional components such as enzymes may require the selection of a product pH that will permit optimum functioning of the component concerned.

The following examples serve to illustrate the performance of an automatic dishwashing detergent formulation incorporating an internal vicinal disulfate.

EXAMPLE V

Granular compositions were prepared in a conventional manner having the following formulae:

| | I | II |
|---|---|---|
| Sodium Tripolyphosphate | 40.4 | 45.7 |
| Chlorinated Trisodium Phosphate | 8.5 | 9.6 |
| Silicate Solids (ratio $SiO_2$:$Na_2O$ = 2.9:1) | 12.0 | 13.7 |
| Pluradot HA 433* | 6.8 | 2.6 |
| $C_{16}$ Vicinal Internal Disulfate | 6.8 | — |
| Water/Miscellaneous | 25.5 | 28.4 |

*Composed of 97% ethylene oxide/propylene oxide condensate of trimethylol propane and 3% monostearyl acid phosphate.

Composition I is in accordance with the invention while Composition II represents a commercially available product.

The above compositions were used for comparative cleaning, spotting and filming evaluations according to the procedure described hereinafter.

Spotting and Filming

An automatic dishwashing machine was filled with dishes. Four test glasses (Libbey Safe Edge 10 oz. tumblers #553) were added in predetermined (the same for all tests) positions in the upper rack. Prior to placement in the machine, two of the test glasses were soiled with a thin film of milk by coating them with refrigerated whole milk. Thirty-five grams of a 4:1 weight mixture of homogenzied margarine and dry milk were placed in a 50 ml. beaker and inverted in the top rack of the dishwasher. The required amount of detergent product was then added to the dispenser cup. The test consisted of four washer cycles whereby the four glasses were graded at the end of the four cycles. The levels of spotting and filming performance were appraised with the aid of a 1–10 scale of photographic standards (separate standards for spotting and filming) wherein 1 represents completely unacceptable performance and 10 represents a level of performance where residual spotting and filming do not occur. The 8 grades (4 spotting); 4 filming) so obtained were averaged to determine average spotting and filming grades.

Cleaning

Two sets of dishes were identically soiled with foods (dried soils, baked soils, cooked soils) and were washed under identical conditions in automatic dishwashers whereby in one dishwasher the detergent composition of this invention and in the second dishwasher a commercially available chlorine-bleach containing detergent was used. The soiled dishes were loaded according to an established loading pattern, i.e., a dish soiled with a given soil was always placed in the same spot in the dishwasher. The soiled surfaces faced the water spray. The washed dishes were graded in a round robin design with the aid of a clean dish and a soiled dish to dimension the range of performance. A 0 to 4 scale was used to evaluate the performance differences, wherein 4 means that in the pair graded, one dish was a whole lot better than the second; 3 means that one dish was a lot better than the second; 2 means that one dish was better than the second; 1 means that one dish was thought to be better than the second; and 0 means that both dishes were equal. A performance grade was calculated for each soil.

The performance grade served for calculating a cleaning grade with the following formula:

$$\frac{\text{Performance Grade Test Dish} - \text{Performance Grade Soiled Dish}}{\text{Performance Grade Clean Dish} - \text{Performance Grade Soiled Dish}} \times 100 = \text{Cleaning Grade}$$

The above compositions were used for comparative automatic dishwashing runs to evaluate the spotting, filming, and cleaning performance according to the testing procedure set forth hereinbefore. Additional test parameters were:

| | |
|---|---|
| Water Hardness: | 15 U.S. grains/gallon |
| Washing Temperature: | 130° F |
| Product Concentration: | Composition I 0.35%<br>Composition II 0.30% |

The usage of the compositions were adjusted to give the same level of phosphate builder in the wash solution.

The cleaning grade results were as follows:

| | Cleaning Grade | |
|---|---|---|
| Food Residue | Composition I | Composition II |
| Dried Soil (egg, rice, spinach, pork) | 79.2 | 84.8 |
| Cooked Soil (beef stroganoff, tapioca, fried egg, scalded milk) | 66.6 | 50.4 |
| Baked Soil (corn, macaroni cheese, beef hamburger) | 61.3 | 58.2 |

-continued

| Food Residue | Cleaning Grade | |
|---|---|---|
| | Composition I | Composition II |
| OVERALL (average) | 69.3 | 64.4 |

These results show that automatic dishwashing detergent compositions formulated to include the internal vicinal disulfates of the present invention demonstrate overall superiority in performance relative to a leading commercially available composition. For the dried food residue, the composition of the invention, although providing a high level of cleaning performance, was not quite as good as the comparative standard. However, for the more difficult-to-remove cooked and baked soils, the composition of the invention provided enhanced cleaning relative to the comparative standard.

The spotting and filming performance were also determined and showed the compositions of this invention to be capable of providing an excellent performance thus contributing to the overall performance superiority of the compositions of this invention versus commercially available dishwashing compositions.

Substantially similar results are also obtained when the nonionic surfactant of Example I is substituted with a substantially identical alkoxylate containing instead of the trimethylolpropane radical an alkylol selected from the group consisting of propylene glycol, glycerine, pentaerythritol and ethylene diamine. Superior automatic dishwashing performance comparable to Example I is also obtained in replacing the trimethylolpropane alkoxylate by an equivalent amount of the condensation product of one mole of tallow alcohol and 9 moles of ethylene oxide.

An excellent performance is also obtained when the monostearyl acid phosphate of Example I is replaced by a silicone suds suppressant selected from the group consisting of dimethyl-, diethyl-, dipropyl-, dibutyl-, methylethyl-, and phenylmethyl-polysiloxane and mixtures thereof in an amount of 0.1%, 0.2%, 0.3%, 0.35%, 0.4%, and 0.45% respectively.

EXAMPLE VI

Slide Pretreatment

Glass, stainless steel, pyrex, and aluminum slides (3 inches × 1 inches × 1/16 inches) were pretreated by soaking in 3A ethanol followed by a 30 minute soak at 120° F in a 0.3% solution of Cascade Dishwashing Product (manufactured by the Proctor & Gamble Company in the U.S.A) and three rinses in distilled water. The slides were then air dried at room temperature.

Soil Preparation

Gravy (protein) and Oatmeal (carbohydrate) soiled slides were prepared in accordance with the following procedures:

| 1. Gravy | |
|---|---|
| Brown Gravy Mix* | 10.5 gm. |
| Chicken Gravy Mix* | 16.0 gm. |
| Sour Cream Sauce* | 17.5 gm. |
| Cheese Sauce Mix* | 17.5 gm. |
| Non-Fat Dry Milk** | 25.0 gm. |
| Distilled $H_2O$ | 178.0 ml. |

*manufactured by R. T. French Company, Rochester, New York, U.S.A.
**manufactured by Carnation Company, Los Angeles, California, U.S.A.

The ingredients were weighed out and mixed dry. Water was added, mechanically mixed, and the moisture wan then allowed to stand for 15 minutes to deareate.

Pretreated slides of each material were soiled using a repeated immersion sequence (5 seconds immersion, 15 seconds withdrawal) over a one minute period after which the slides were air dried for 10 minutes and then baked at 300° F for 15 minutes before being allowed to cool.

2. Oatmeal 15 gm. of oatmeal (Quick Quaker Oats supplied by the Quaker Oats Company) was mixed with 180 ml. water and then heated to boiling and held at boiling point for 1 minute with stirring. The mixture was allowed to cool slightly and given one minute further stirring at low speed in a Waring Blender.

A similar soiling procedure to that used for the gravy soil was employed with the exception that the baking step took place at 150° F.

TEST PRODUCTS

Formulations were made up as follows (parts by weight):

| | I | II | III | IV | V | VI | VII |
|---|---|---|---|---|---|---|---|
| Nonionic surfactant | 2.6[1] | 5.0[1] | 5.0[1] | 5.0[1] | 5.0[1] | 5.0[2] | 5.0[2] |
| Sodium sulfate | — | 40.0 | 40.0 | 40.0 | 30.0 | 30.0 | 30.0 |
| Sodium tripolyphosphate | 44.6 | — | — | — | — | — | — |
| Sodium carbonate | — | 31.0 | 31.0 | 31.0 | 30.0 | 30.0 | 30.0 |
| Sodium silicate ($SiO_2$:$Na_2O$ = 2:1) | 13.5 | 17.0 | 17.0 | 17.0 | 20.0 | 20.0 | 20.0 |
| Polymeric glassy phosphate | — | 2.0 | 2.0 | 2.0 | 1.0 | 1.0 | 1.0 |
| Suds suppressor | — | — | — | — | 3.0 | 3.0 | 3.0 |
| Bleach | 9.6 | — | — | — | 4.0 | 4.0 | 4.0 |
| Internal vicinal disulfate | — | — | 5.0[3] | 5.0[4] | 5.0[5] | 8.0[5] | 8.0[6] |

[1]Pluradot HA 433®, an ethylene oxide-propylene oxide condensate of trimethylol propane sold by Wyandotte Chemical Corporation.
[2]Triton® CF 32, an amine polyglycol condensate sold by Rohm & Haas Company.
[3]Sodium $C_{16}$ random internal vicinal disulfate.
[4]Trisodium 9-10 dihydroxy stearic acid disulfate.
[5]Sodium $C_{12}$ random internal vicinal disulfate.
[6]Sodium $C_{20}$ random internal vicinal disulfate.

The previously soiled slides were given a final treatment by dipping into a cooking oil (Crisco, sold by The Procter & Gamble Company, U.S.A.) and draining to remove supernatent liquid. Each soil/slide material combination was given a 10 minute tergotometer wash at 130° F in 0.3% solution of each of products I-VII, rinsed, and then air dried. Each slide was then dyed with a solution of iodine and potassium iodide in water to facilitate grading and was then graded using a visual technique. In this technique each slide is assigned a number ranging from 0 (equal to an untreated glass slide, i.e., the control) to 4 (a totally clean slide). Intermediate grades of 1 (slightly better than control), 2 (a definite noticeable improvement), and 3 (slide is almost clean) are used.

In the above experiments, Formulation I (a leading commercial automatic dishwashing product) was used as the control and its score in the above test was accorded a value of 0 in the table of results given below so that the scores reflect only a relative performance and not an absolute performance.

| | I | II | III | IV | V | VI | VII |
|---|---|---|---|---|---|---|---|
| Glass-baked on oatmeal + Crisco oil dip | 0 | −2 | +1 | +1 | +2 | −1 | −2 |
| Glass-baked on gravy mix + Crisco oil dip | 0 | 0 | +3 | +3 | +2 | +3 | +3 |
| Stainless steel-baked on gravy mix + Crisco oil dip | 0 | −4 | 0 | 0 | −4 | +2 | +3 |
| Aluminum-baked on oatmeal + Crisco oil dip | 0 | −2 | 0 | +3 | +3 | 0 | 0 |
| Aluminum-baked on gravy mix + Crisco oil dip | 0 | −2 | −3 | −2 | −3 | −2 | +3 |

It can be seen that products III-V that incorporate the compounds of the present invention perform in every case better than product II, which is the same formulation without the compounds. Products VI and VII that are of a slightly different formulation also perform better than product II. Furthermore, all of the compositions incorporating the compounds of the invention (III–VII inclusive) perform equally as well as, or better than, the control product I. In this respect it should be noted that the control product I is a 46% phosphate built product, whereas all of the other products contain 2% or less phosphate.

The internal vicinal disulfates of this invention can be used in effective detergent compositions having improved cleaning benefits, excellent compatibility with the other detergent additives, and improved cleaning in greasy soil systems. They have the following formulas, parts, and percentages being by weight.

EXAMPLE VII

| Automatic Dishwashing Detergent | % |
|---|---|
| Disodium-6,7-n-hexadecane disulfate | 6 |
| Sodium tripolyphosphate (6 $H_2O$) | 60 |
| Sodium metasilicate | 20 |
| Sodium dichloroisocyanurate | 2 |
| Sodium sulfate | 10 |
| Pluradot HA-433* | 1 |
| Miscellaneous (dyes, perfumes, etc.) | Balance |

*Pluradot HA-433 is a nonionic synthetic detergent containing 3% monostearyl acid phosphate and is produced by Wyandotte Corporation.

EXAMPLE VIII

| Liquid Built Detergent | % |
|---|---|
| Disodium-2,3-n-dodecane disulfate | 5 |
| Sodium $C_{11.8}$ linear alkyl benzene sulfonate | 20 |
| Diethanolamide | 5 |
| Sodium $C_{12-15}$ primary alcohol ethoxy sulfate | 10 |
| Ethanol | 5 |
| Water | 53 |
| Miscellaneous | Balance |

EXAMPLE IX

| Granular Laundry Detergent | % |
|---|---|
| Disodium-2,3-n-dodecane disulfate | 5 |
| Sodium $C_{11.8}$ linear alkyl benzene sulfonate | 12 |
| Sodium tripolyphosphate | 53 |
| Sodium silicate ($Na_2O:SiO_2$ = 1:2.4) | 6 |
| Sodium toluene sulfonate | 2 |
| Sodium carboxymethylcellulose | 0.3 |
| Sodium sulfate | 13 |
| Water | 8 |
| Miscellaneous | Balance |

EXAMPLE X

| Granular Detergent | Part |
|---|---|
| Disodium-5,6-tetradecane disulfate | 1 |

EXAMPLE X-continued

| Granular Detergent | Part |
|---|---|
| Potassium ethylenediaminetetraacetate | 2 |

EXAMPLE XI

| Granular Detergent | Part |
|---|---|
| Trisodium 9,10-disulfate stearate | 1 |
| Potassium pyrophosphate | 5 |

EXAMPLE XII

| Milled Toilet Bar | % |
|---|---|
| Disodium-5,6-tetradecane disulfate | 10 |
| Sodium coconut oil soap | 15 |
| Sodium tallow soap | 60 |
| Triethanolammonium ethylenediamine-tetraacetate | 5 |
| Moisture | 10 |

EXAMPLE XIII

| Framed Toilet Bar | % |
|---|---|
| Disodium-3,4-n-dodecane disulfate | 5 |
| Sodium dodecylbenzene sulfonate | 57 |
| Glyceryl tristearate | 38 |

EXAMPLE XIV

| Scouring Cleanser | % |
|---|---|
| Silica flour | 85 |
| Detergent consisting of 85% trisodium phosphate and 15% sodium-2,3-hexadecane disulfate | 15 |

EXAMPLE XV

| Liquid Detergent | % |
|---|---|
| Condensation reaction product of coconut alcohol and 6 moles of ethylene oxide | 35 |
| Disodium-2,3-n-dodecane disulfate | 20 |
| Oleic acid | 1.5 |
| Potassium chloride | 2.5 |
| Ethyl alcohol | 5.0 |
| Water | Balance |

What is claimed is:

1. An automatic dishwashing detergent composition consisting essentially of:

a. from about 3% to about 10% of an internal vicinal disulfate having the formula

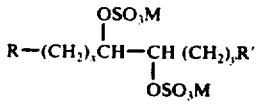

wherein $x$ and $y$ are integers from 2 to 16 inclusive; the sum of $x + y = 10$ to 18; R is hydrogen; R′ is selected from the group consisting of hydrogen and COOM; and wherein M is a cation selected from the group consisting of alkali metal, alkaline earth metal, ammonium and alkanolammonium cations, and b. from about 10% to about 60% of a water soluble detergent builder salt selected from the group consisting of alkali metal polyphosphates, carbonates, bicarbonates, silicates, citrates, nitrilotriacetates and mixtures thereof.

2. The detergent composition of claim 1 containing from 2.5% to 10% by weight of a nonionic surfactant selected from the group consisting of ethoxylated $C_8$–$C_{20}$ branched and linear aliphatic primary and secondary alcohols containing an average of 2 to 12 ethylene oxide groups, ethoxylated $C_6$–$C_{12}$ alkyl phenols containing an average of 5 to 10 ethylene oxide groups, and ethylene oxide-propylene oxide condensates.

3. A composition in accordance with claim 3 wherein R′ is hydrogen.

4. A composition in accordance with claim 2 wherein R′ is hydrogen.

5. A light duty liquid detergent formulation containing from about 3% to about 25% of an internal vicinal disulfate surfactant compound having the formula:

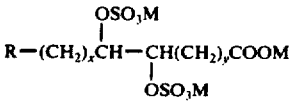

where $x$ and $y$ are integers from 2 to 16 inclusive; the sum of $x + y = 10$ to 18; R is hydrogen; and wherein M is a cation selected from the group consisting of alkali metal, alkaline earth metal, ammonium and alkanolammonium cations.

6. A detergent composition in accordance with claim 5 wherein the internal vicinal disulfate has the formula

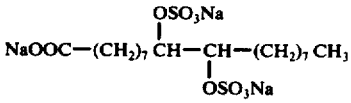

* * * * *